United States Patent [19]

Dekura

[11] Patent Number: 4,603,962

[45] Date of Patent: Aug. 5, 1986

[54] IMAGE FORMING APPARATUS WITH A DISPLAY DEVICE FOR MATCHING THE IMAGE SIZE WITH THE COPYING SHEET SIZE

[75] Inventor: Hitoshi Dekura, Tokyo, Japan

[73] Assignee: Kabushiki Kaisha Toshiba, Kawasaki, Japan

[21] Appl. No.: 602,690

[22] Filed: Apr. 23, 1984

[30] Foreign Application Priority Data

Apr. 26, 1983 [JP] Japan ..... 58-73383

[51] Int. Cl.[4] ..... G03G 21/00

[52] U.S. Cl. ..... 355/3 R; 355/3 SH; 355/14 R; 355/55

[58] Field of Search ..... 355/3 R, 3 SH, 14 SH, 355/14 R, 14 C, 55–57

[56] References Cited

U.S. PATENT DOCUMENTS

| | | | |
|---|---|---|---|
| 4,176,941 | 12/1979 | Breitenkam et al. | 355/14 R |
| 4,277,165 | 7/1981 | Wada et al. | 355/55 |
| 4,302,098 | 11/1981 | Kan et al. | 355/3 SH |
| 4,382,674 | 5/1983 | Miyoshi et al. | 355/3 SH |
| 4,406,537 | 9/1983 | Mori | 355/3 SH |

*Primary Examiner*—R. L. Moses

*Attorney, Agent, or Firm*—Cushman, Darby & Cushman

[57] ABSTRACT

A copying apparatus includes selection switches for selecting a cassette in which specified size copying sheets are contained and are to be fed into the copying apparatus in a specified direction, selection switches for selecting an operation mode in response to which a required image-forming-magnification-factor is selected, and a display panel for displaying an operation condition of the copying apparatus. The display panel displays a mismatch between the selected cassette and the selected operation mode and also displays a guidance for matching a cassette to be selected to the selected operation mode.

2 Claims, 42 Drawing Figures

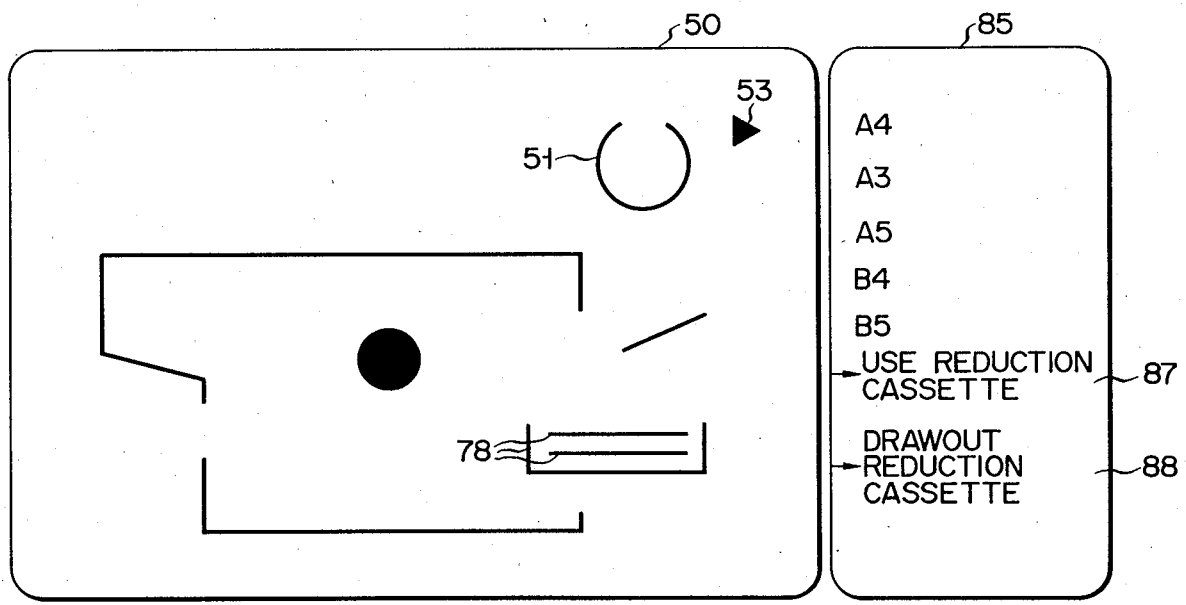
FIG. 9
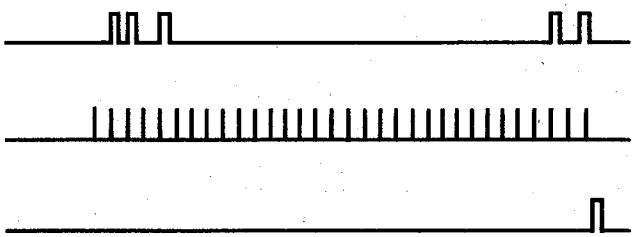
FIG. 10A
FIG. 10B
FIG. 10C

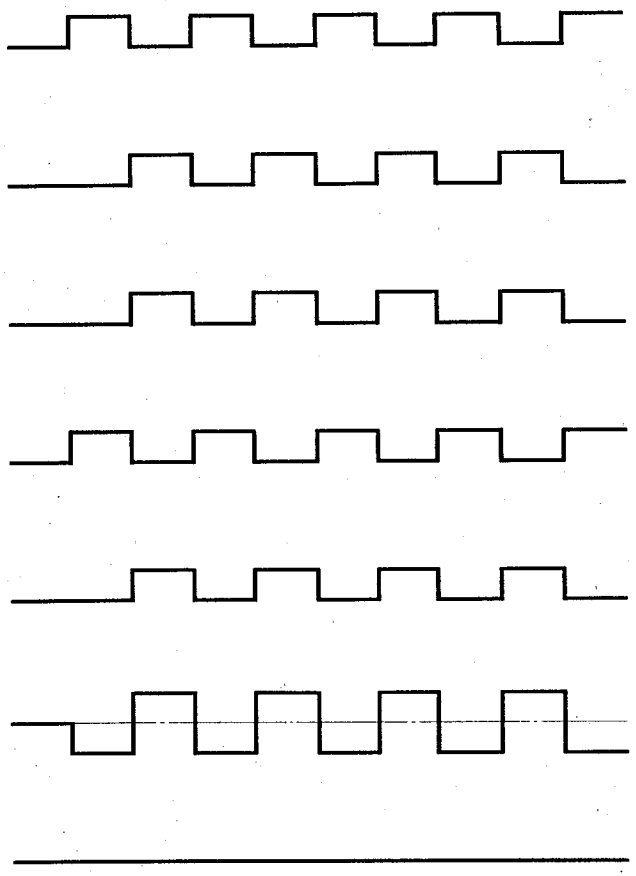
FIG. 11A DRIVING PULSE A
FIG. 11B DRIVING PULSE B
FIG. 11C VOLTAGE ON COMMON ELECTRODE 96
FIG. 11D VOLTAGE ON SEGMENTS S1, S3, S28, S30, S31
FIG. 11E VOLTAGE ON SEGMENTS S2, S4~S27, S29, S32
FIG. 11F VOLTAGE BETWEEN COMMON ELECTRODE 96 AND SEGMENTS S1, S3, S28, S30, S31
FIG. 11G VOLTAGE BETWEEN COMMON ELECTRODE 96 AND SEGMENTS S2, S4~S27, S29, S32

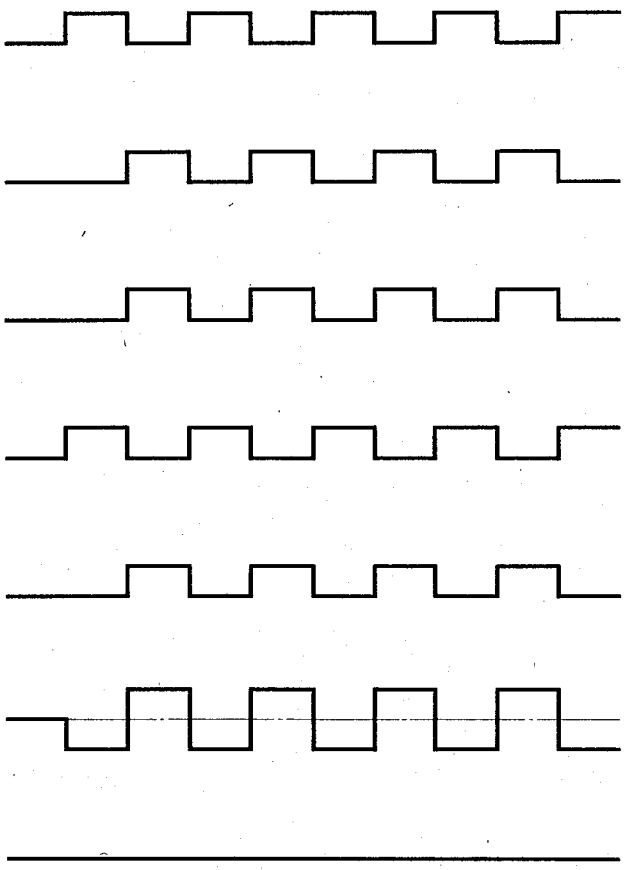
FIG. 14A DRIVING PULSE A
FIG. 14B DRIVING PULSE B
FIG. 14C VOLTAGE ON COMMON ELECTRODE 96
FIG. 14D VOLTAGE ON SEGMENTS S3, S10, S28, S30, S31
FIG. 14E VOLTAGE ON SEGMENTS S1, S2, S4~S9, S11~S27, S29, S32
FIG. 14F VOLTAGE BETWEEN COMMON ELECTRODE 96 AND SEGMENTS S10, S28, S30, S31
FIG. 14G VOLTAGE BETWEEN COMMON ELECTRODE 96 AND SEGMENTS S1, S2, S4~S9, S11~S27, S29, S32

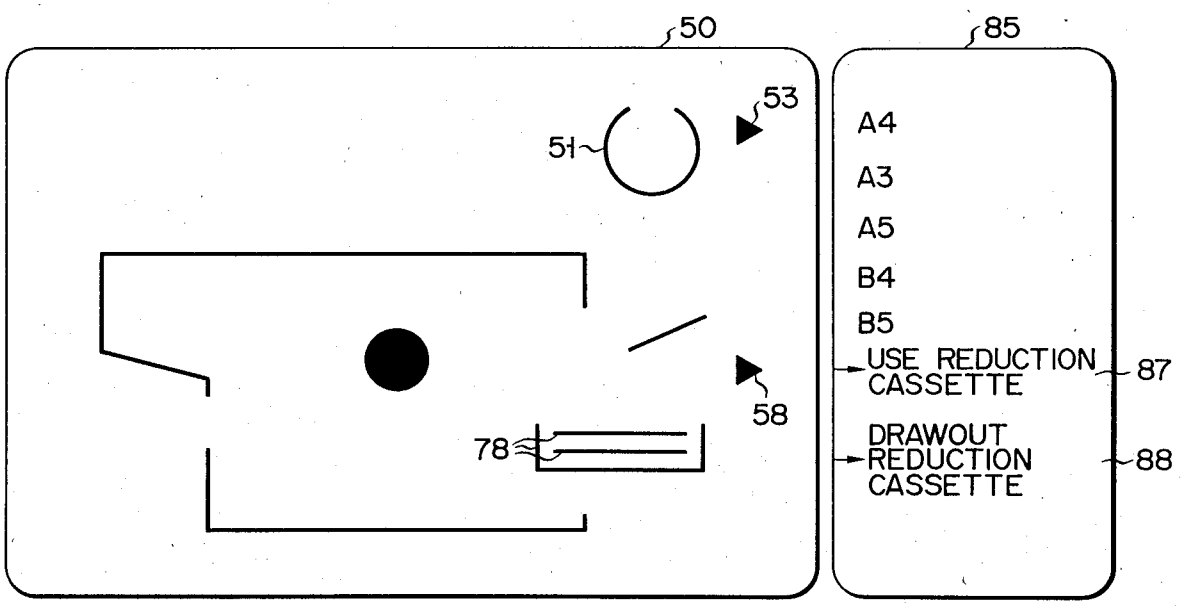
FIG. 15
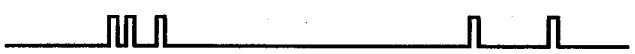
FIG. 16A
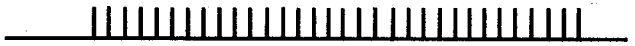
FIG. 16B
FIG. 16C

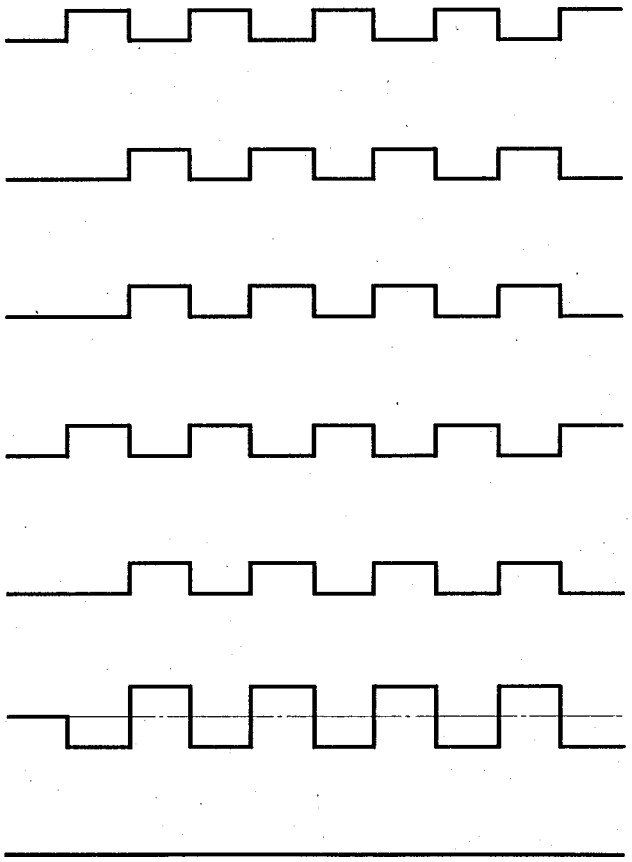
FIG. 17A DRIVING PULSE A
FIG. 17B DRIVING PULSE B
FIG. 17C VOLTAGE ON COMMON ELECTRODE 96
FIG. 17D VOLTAGE ON SEGMENTS S3, S8, S28, S30, S31
FIG. 17E VOLTAGE ON SEGMENTS S1, S2, S4~S7, S9~S27, S29, S32
FIG. 17F VOLTAGE BETWEEN COMMON ELECTRODE 96 AND SEGMENTS S3, S8, S28, S30, S31
FIG. 17G VOLTAGE BETWEEN COMMON ELECTRODE 96 AND SEGMENTS S1, S2, S4~S7, S9~S27, S29, S32

IMAGE FORMING APPARATUS WITH A DISPLAY DEVICE FOR MATCHING THE IMAGE SIZE WITH THE COPYING SHEET SIZE

BACKGROUND OF THE INVENTION

The present invention relates to an image forming apparatus and, more particularly, to an image forming apparatus having means for giving an effective indication to an operator when a selected cassette for feeding a copying sheet does not match a selected operation mode.

Among image forming apparatuses such as copying apparatuses, an image forming apparatus is known which has an operation mode for selecting a copying magnification factor. In this case, when the selected copying magnification factor does not match the size and feeding direction of the copying sheet, the following problem occurs. For example, if an equal size copying cassette is selected when a reduction copying mode is instructed, the equal size copying cassette is set and a cassette corresponding to the reduction copying mode is not set in the copying apparatus and a reduced image of the document is copied on part of a copying sheet fed from the equal size copying cassette, thereby resulting in a wasted portion of the copying sheet. On the other hand, assume that a reduction cassette is selected although an equal size copying mode is instructed. Part of the document image cannot be copied on the copying sheet, which must then be scrapped. Therefore, if means for indicating a mismatch between the instructed operation mode and the size and feeding direction of the copying sheet, and means for giving an operator a guidance for matching the operation mode with the size and feeding direction of the copying sheet are simultaneously provided, the above-mentioned problem can be solved.

SUMMARY OF THE INVENTION

It is an object of the present invention to provide an image forming apparatus having a display means for displaying a mismatch between an instructed operation mode of the image forming apparatus and the size and feeding direction of an image forming sheet, and a guidance means for matching the size and feeding direction of the image forming sheet with the instructed operation mode.

An image forming apparatus according to this invention comprises means for selecting one cassette, which is set in the image forming apparatus, each of the cassettes holding a plurality of image forming sheets having a specified size and a specified feeding direction of the sheets; means for detecting the specified size and the specified feeding direction of the image forming sheets contained in the selected cassette; means for selecting an operation mode in response to which a required image forming magnification factor is selected; and display means for displaying operating conditions of the image forming apparatus. The display means comprises first display means for indicating that the selected cassette and the selected operation mode are mismatched; and second display means provided corresponding to the first display means, the second display means giving guidance for matching a cassette to be selected with the selected operation mode.

According to the image forming apparatus of the present invention, the operator can easily match the selected operation mode with the size and feeding direction of the image forming sheet. Therefore, wastage of image forming sheets can be prevented.

BRIEF DESCRIPTION OF THE DRAWINGS

FIG. 9 shows an example of a display at the display section when the selected operation mode matches with the selected cassette;

FIGS. 10A to 10C are timing charts of input signals to the liquid-crystal-display-element driving circuit in FIG. 7 for performing the display operation of FIG. 9;

FIGS. 11A to 11G show voltage waveforms of the respective parts of the circuit of FIG. 7 when the display operation of FIG. 9 is performed;

FIGS. 14A to 14G show voltage waveforms of the respective liquid crystal parts of the circuit of FIG. 7 when the display operations of FIG. 12 is performed;

FIG. 15 shows a second example of a display when the selected operation mode does not match with the selected cassette;

FIGS. 16A to 16C are timing charts of input signals to the liquid-crystal-display-element driving circuit in FIG. 7 for performing the display operation of FIG. 15; and FIG. 17A to 17G show voltage waveforms of the respective parts of the circuit of FIG. 7 when the display operation of FIG. 15 is performed.

DETAILED DESCRIPTION OF THE PREFERRED EMBODIMENT

Figure 1:
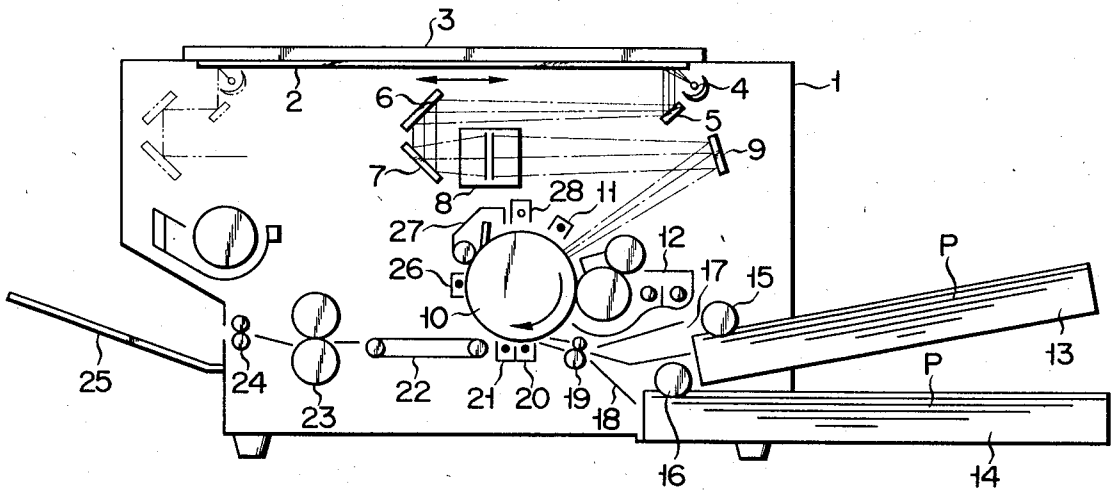
FIG. 1 is a sectional view showing the overall configuration of a copying apparatus according to an embodiment of the present invention.

Referring to FIG. 1, a document supporting plate (transparent glass plate) 2 is disposed at the top portion of a main casing 1 of the copying apparatus to support a document to be copied. A depression member 3 is disposed above the document supporting plate 2 to be freely opened/closed. An exposure optical device is disposed under the document supporting plate 2. The exposure optical device includes an exposure lamp 4, mirrors 7, each of which reciprocates in the directions indicated by the arrows in FIG. 1, a copying-magnification-factor-setting lens block 8, and a stationary mirror 9. The document surface is optically scanned by the exposure optical device to focus the optical image of the document on a photosensitive drum 10 through a slit. The surface of the photosensitive drum 10 is charged by a first charger (charge depositing charger) 11 while the photosensitive drum 10 is rotated in the direction indicated by the arrow. A latent image of the document is formed on a charged drum surface portion in accordance with the slit exposure. Thereafter, a toner is applied by a developing unit 12 to the latent image, so that the latent image becomes a toner or visible image.

Copying sheets P are set in an upper copying-sheet-feeding cassette 13 and a lower copying-sheet-feeding cassette 14. These cassettes 13 and 14 are selectively used. The sheets are taken out one by one by a sheet removing roller 15 or 16. Each sheet is guided to a resist roller pair 19 along a sheet guiding path 17 or 18. The sheet P is then fed to an image transcribing portion in accordance with the operation of the resist roller pair 19. The cassettes 13 and 14 are detachably mounted at the right lower portion of the main casing 1. Either of the cassettes 13 and 14 is selectively used in accordance with an instruction at the operation panel (to be described later). The copying sheet P fed to the image transcribing portion is brought into tight contact with the surface of the drum 10 at a position where a second charger (transcribing charger) 20 is positioned. The copying sheet P is then charged by the second charger 20. As a result, the toner image on the surface portion of the drum 10 is transcribed to the sheet P. The sheet P then receives a charge from a third charger (separation charger) 21, and is separated from the drum surface. The sheet P is transferred to a fixing roller pair 23 along a sheet transfer path 22. The toner image is fixed on the sheet P when the sheet P passes through the fixing roller pair 23. The image-fixed sheet P is discharged into a tray 25 outside the main casing 1 through a discharge roller pair 24. The charge on the drum surface portion after the image transcribing process is discharged by a fourth charger (charge removing charger) 26. In addition, the remaining toner is removed by a cleaner 27, and the remaining latent image is removed by a fluorescent lamp 28. As a result, the drum surface portion after the transcribing process is restored to its initial state.

Figure 2:
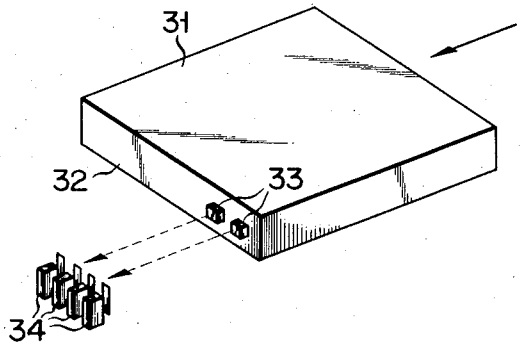
FIG. 2 is a perspective view showing a cassette for holding copying sheets, and a mechanism for detecting the size and feeding direction of the copying sheets.

Referring to FIG. 2, which shows a size detection mechanism for detecting the size of the sheet P, a plurality of projected members 33 are disposed at a front end surface 32 (e.g., with an insertion direction along the arrow) of a copying-sheet-feeding cassette 31 (corresponding to each of the cassettes 13 and 14 in FIG. 1). The size (i.e., cassette size) and the feeding direction of the copying sheet P are detected in accordance with a combination of the projected members 33. In particular, when the cassette 31 is inserted in the main casing 1 in the direction indicated by the arrow, a plurality of microswitches 34 are turned on/off when they are selectively brought into contact with the projected members 33. The cassette size can be detected by the combination of the on/off microswitches.

Figure 3B:
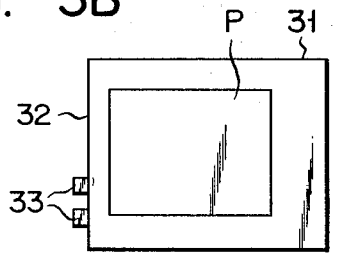
FIGS. 3A and 3B are plan views showing the relative relationships among a cassette, the copying sheet size and the feeding direction.
Figure 3A:
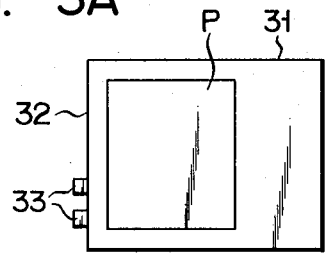

The cassette size will now be described with reference to FIGS. 3A and 3B. The cassette 31 shown in FIG. 3A stores A-size copying sheets P to be fed along the direction indicated by the arrow (i.e., the short side thereof), while the cassette 31 shown in FIG. 3B stores A-size copying sheets P to be fed along the direction of the arrow (i.e., the long side thereof). The sizes and feeding directions of these two types of copying sheets P are detected by combinations of the microswitches 34 turned on/off by the projected members 33 formed on the front end faces 32 of the corresponding cassettes 31 (FIG. 2). In general, the copying sheet sizes include, for example, A4, A3, A5, B4 and B5 sizes. The A4, A5 and B5 size sheets are stored in cassettes having the same size and may be fed along either of the feeding directions shown in FIG. 3A and FIG. 3B. In the present invention, the cassette for storing the copying sheets to be fed along the feeding direction shown in FIG. 3A is defined as the equal-size-copying cassette, and as shown in FIG. 3B is defined as the reduction cassette. The operator can easily select a copying sheet with a size corresponding to that of the document to be copied. Nevertheless, he often makes a mistake and selects an erroneous cassette from between the equal-size-copying cassette (FIG. 3A) and the reduction cassette (FIG. 3B).

Figure 4:
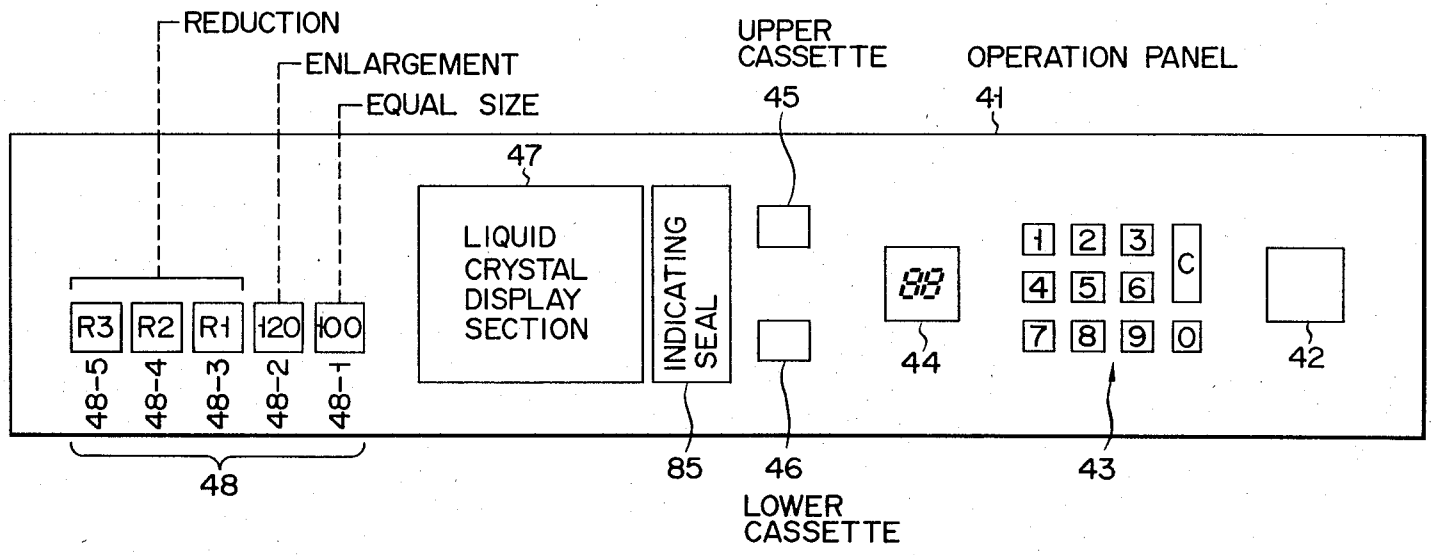
FIG. 4 is a plan view of an operation panel of the copying apparatus shown in FIG. 1.

An operation panel 41 of the copying apparatus, as shown in FIG. 4, has a copying key 42 for starting the copying operation, a numeric key section 43 for presetting the copying sheet number, a preset number display section 44 for displaying the preset sheet number, an upper cassette selection key 45 for selecting the upper copying-sheet-feeding cassette 13, a lower cassette selection key 46 for selecting the lower copying-sheet-feeding cassette 14, a liquid crystal display section 47 for displaying the operation status of the copying apparatus and the selection states of the copying conditions, an indicating seal 85, and a magnification factor setting key 48 for inputting a copy size.

Figure 5:
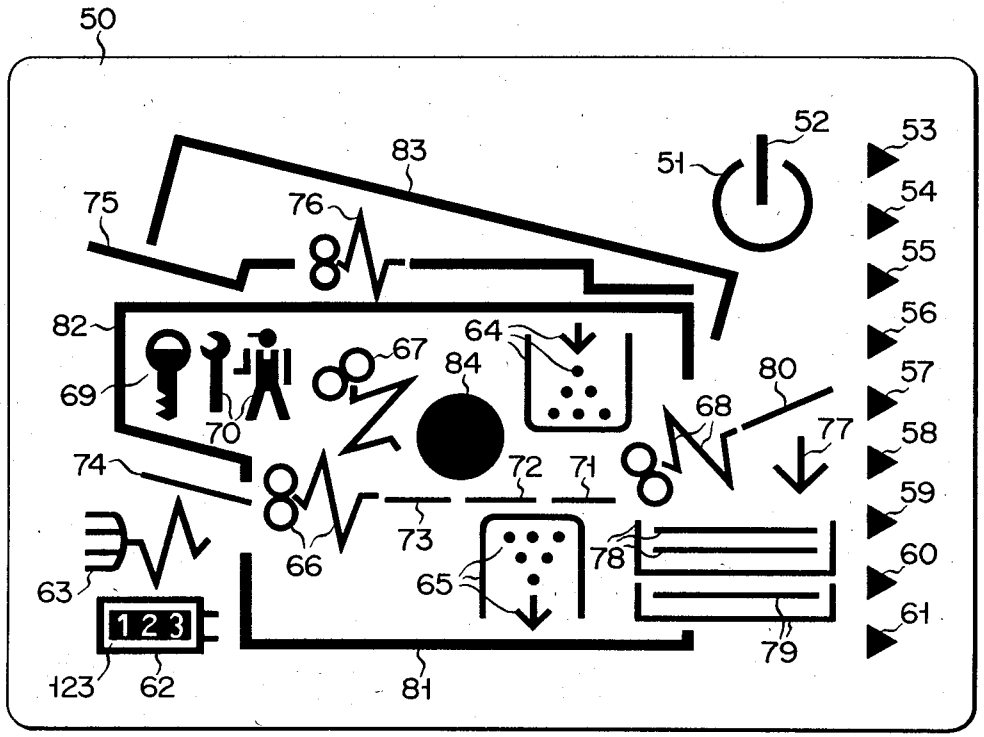
FIG. 5 is a plan view showing a display pattern of display elements in a display section of the copying apparatus shown in FIG. 1.

FIG. 5 shows the arrangement of the liquid-crystal-display segments (i.e., a display example of the liquid crystal display section 47). Referring to FIG. 5, reference numeral 50 denotes a liquid-crystal-display panel; and 51 and 52, segments for displaying whether or not the copying apparatus is set in the ready mode. When only the segment 51 is turned on, the copying apparatus is set in the ready mode. However, when the segments 51 and 52 are simultaneously turned on, the copying apparatus is set in the warm-up mode. Reference numerals 53 to 57 denote segments for indicating the sizes of the selected copying sheets P; and 58 to 61, segments for displaying the state wherein the selected copying magnification factor does not match the size of the copying sheet P. Reference numeral 62 denotes a segment for displaying that the key counter is set; 63, a segment for displaying a sheet jam in the sorter; 64, a segment for displaying that the toner hopper of the developing unit 12 is empty; and 65, a segment for displaying that the recovery toner storage section is filled with recovered toner. Reference numeral 66 denotes a segment for displaying that a sheet jam has occurred in the sheet transfer path through the fixing roller pair 23 or in the vicinity thereof; 67, a segment for displaying that the copying sheet P is wound around the photosensitive drum 10 or the cleaner 27, or that a sheet jam has occurred on the photosensitive drum 10 or the cleaner 27; and 68, a segment for displaying that a sheet jam has occurred in a transfer path (not shown) for transferring a manually fed copying sheet. Reference numeral 69 denotes a segment for displaying an instruction to call the key operator; 70, a segment for displaying an instruction to call the service man; 71 to 73, segments for displaying the transfer states of the copying sheet P; 75, a segment for displaying that a document feeder is connected; 76, a segment for displaying that a sheet jam has occurred in the document feeder; 77, a segment for displaying that the copying sheet feeding cassette 13 or 14 is empty; 78, a segment for displaying that the upper copying-sheet-feeding cassette 13 has been selected; and 79, a segment for displaying that the lower copying-sheet-feeding cassette 14 has been selected. Reference numeral 80 denotes a segment for displaying that a manual sheet-feeding plate is being used; 81, a segment for displaying the lower cover of the main casing 1; 83, a segment for displaying that the upper cover of the main casing 1 is open 82, a segment for displaying that the upper cover is closed; and 84, a segment for displaying the photosensitive drum 10. A common electrode 96 (FIG. 7) is arranged to oppose these segments.

Figure 6:
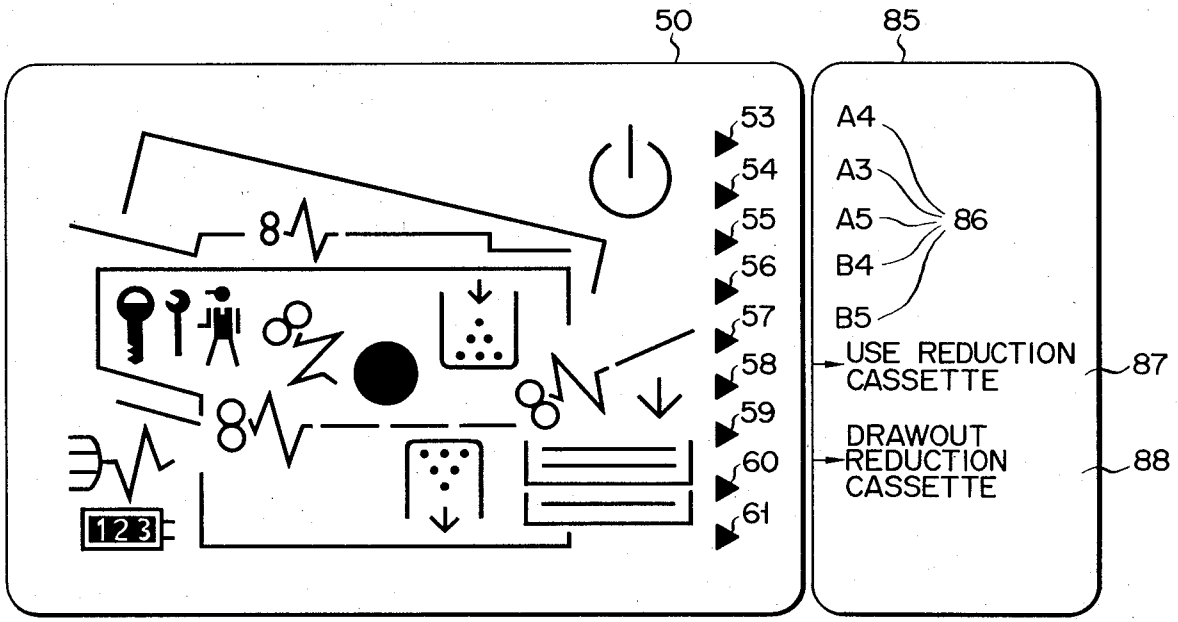
FIG. 6 is a plan view showing another display pattern obtained when an indicating seal, including guidance and sheet size indicators, is added to the pattern shown in FIG. 5.

FIG. 6 shows a method of displaying the sizes of the copying sheets P corresponding to the display contents of the segments 53 to 57, and a guidance (handling contents) corresponding to the display contents when the segments 58 to 61 display that the selected copying magnification factor does not match the selected cassette (i.e., the size and feeding direction of the copying sheet P). In particular, an indicating seal 85, which is printed with the sizes of the copying sheets P, and guidance is adhered to the vicinity of the right side of the display panel 50. The sheet sizes 86 (e.g., A4, A3, A5, B4 and B5) are printed at positions on the seal 85 which respectively oppose the segments 53 to 57. In addition, guidances 87 and 88, for indicating the operation to be performed in accordance with the mismatch between the copying magnification factor and the copying sheet size, are printed at positions opposing the segments 58 and 60. In this embodiment, the segments 59 and 61 are provided as supplementary segments, so that these guidances are displayed in correspondence with the segments 58 and 60. The guidance 87 "USE REDUCTION CASSETTE" is printed at the position corresponding to the segment 58. The guidance 88 "DRAW OUT REDUCTION CASSETTE" is printed at the position corresponding to the segment 60. The size of the copying sheet P can be displayed by turning on a segment corresponding to the size of the sheets P stored in the copying-sheet-feeding cassette. For example, when an A4-size cassette is selected, the segment 53 is turned on. In the embodiment, the segments 53 to 57 are turned on to provide a green display, and the segments 58 and 60 are turned on to provide a yellow display, thereby effectively performing the operation of the copying apparatus.

Figure 7:
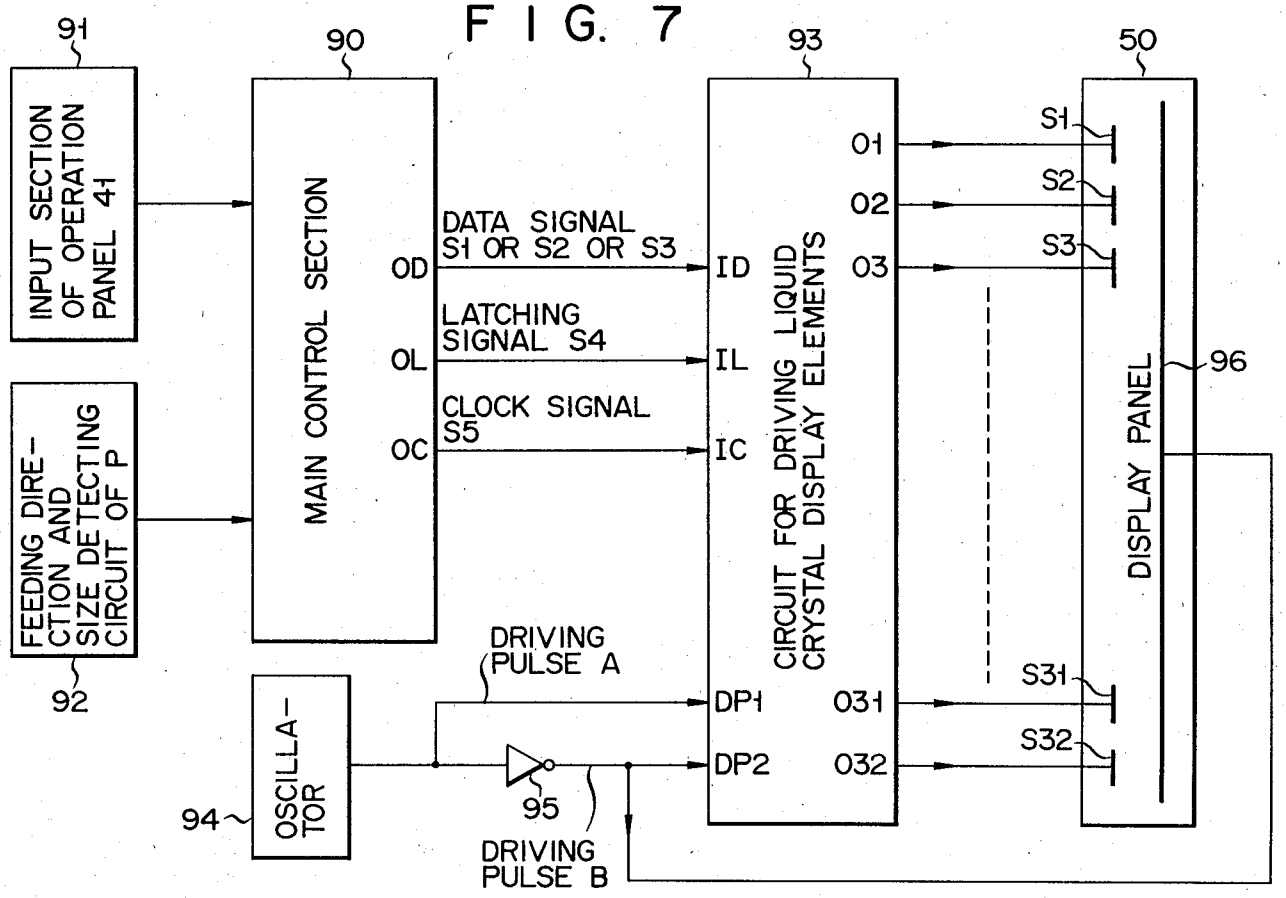
FIG. 7 is a block diagram of a control circuit of the display section.

FIG. 7 is a block diagram of a display control circuit for turning on the segments shown in FIG. 5. An input section 91 of the operation panel 41 (FIG. 4) and a detecting circuit 92 for detecting the size and feeding direction of the copying sheet P are connected to a main control section 90 including a microcomputer. The input section 91 includes the copying key 42, the ten key input section 43 for setting the number of sheets to be copied, the selection key 45 of the upper copying-sheet-feeding cassette 13, the selection key 46 of the lower copying-sheet-feeding cassette 14, and the magnification-factor setting key 48. The main control section 90 entirely controls the copying apparatus and generates from the output terminal OD a 32-bit data signal S1, S2, or S3 including the information corresponding to the operation of the input section 91 and the information from the copying sheet size and its feeding-direction detecting circuit 92. The main control section 90 also generates a latching signal S4 and a clock signal S5 from its output terminals OL and OC, respectively.

Input terminals ID, IL and IC of a driving circuit 93 of liquid-crystal-display elements (segments) receive the signals generated from the output terminals of the main control section 90. In this case, the 36-bit data signal from the output terminal OD is supplied to the driving circuit 93 in synchronism with the clock signal S5 supplied from the output terminal OC to the input terminal IC. An oscillator circuit 94 generates a driving pulse A having an optimal frequency suitable for driving the liquid-crystal-display segments. The driving pulse A is supplied to an input terminal DP1 of the driving circuit 93. An inverter 95 inverts the pulse A, and this inverted pulse is supplied to an input terminal DP2 of the driving circuit 93. The segment driving signals corresponding to the contents of the data signals supplied to the input terminal ID appear at output terminals 01 to 032 of the driving circuit 93. Each driving signal is supplied to a corresponding segment among the segments S1 to S32. A driving pulse B is supplied to the common electrode 96 arranged to oppose the segments S1 to S32. The relationship between the segments 51 to 84 (FIG. 5) and segments S1 to S32 (FIG. 7) is illustrated in the following table. As is apparent from the table, the segments 80, 81 and 84 in FIG. 5 are commonly connected to the segment S30 in FIG. 7.

TABLE

| Segments in FIG. 7 | Segments in FIG. 5 | Segments in FIG. 7 | Segments FIG. 5 |
|---|---|---|---|
| S1 | 51 | S17 | 67 |
| S2 | 52 | S18 | 68 |
| S3 | 53 | S19 | 69 |
| S4 | 54 | S20 | 70 |
| S5 | 55 | S21 | 71 |
| S6 | 56 | S22 | 72 |
| S7 | 57 | S23 | 73 |
| S8 | 58 | S24 | 74 |
| S9 | 59 | S25 | 75 |
| S10 | 60 | S26 | 76 |
| S11 | 61 | S27 | 77 |
| S12 | 62 | S28 | 78 |
| S13 | 63 | S29 | 79 |
| S14 | 64 | S30 | 80, 81, 84 |
| S15 | 65 | S31 | 81 |
| S16 | 66 | S32 | 82 |

Figure 8:
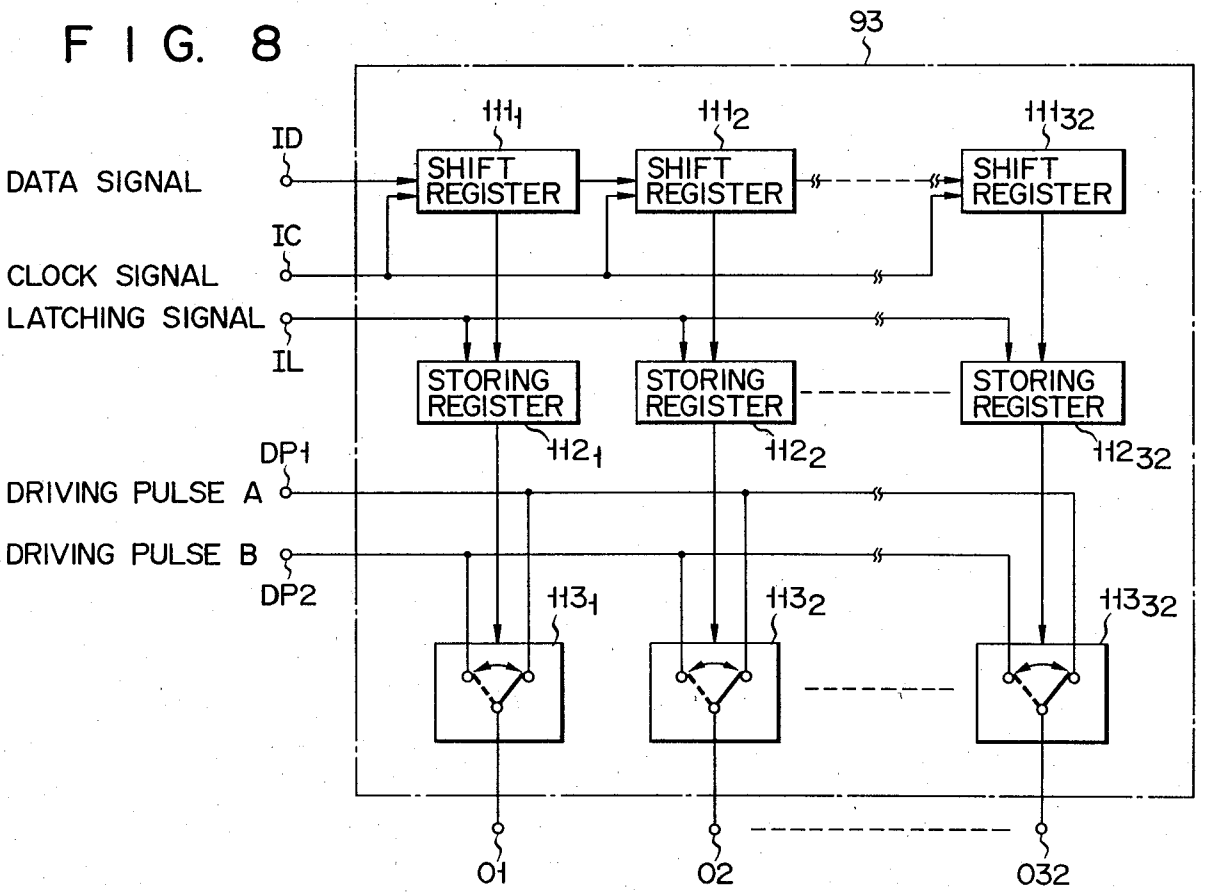
FIG. 8 is a detailed view of the circuit in FIG. 7 for driving liquid-crystal-display elements.

FIG. 8 is a detailed circuit diagram of the driving circuit 93 (FIG. 7) for driving the liquid-crystal-display elements. Referring to FIG. 8, 32 shift registers $\mathbf{111}_1$ to $\mathbf{111}_{32}$ are cascade-connected to the data signal input terminal ID. The clock signal S5 from the clock signal input terminal IC is supplied to the input terminal of each of the shift registers. The 32-bit data signal S1, S2 or S3 from the terminal ID is transferred by being shifted by each of the shift registers in response to the clock signal S5 from the terminal IC. Storing registers $\mathbf{112}_1$ to $\mathbf{112}_{32}$ for storing the contents of the corresponding shift registers in response to the latching signal S4 are connected to the shift registers $\mathbf{111}_1$ to $\mathbf{111}_{32}$, respectively. Switches $\mathbf{113}_1$ to $\mathbf{113}_2$ are connected to the output terminals of the storing registers $\mathbf{112}_1$ to $\mathbf{112}_{32}$, respectively. The driving pulse A from a terminal DP1 is supplied to one input terminal of each of the switches $\mathbf{113}_1$ to $\mathbf{113}_{32}$. The driving pulse B from the terminal DP2 is supplied to the other input terminal of each of the switches $\mathbf{113}_1$ to $\mathbf{113}_{32}$. These switches $\mathbf{113}_1$ to $\mathbf{113}_{32}$ respectively generate the driving pulse A or B from output terminals 01 to 032. For example, when the storing register $\mathbf{112}_1$ stores data "1", the driving pulse A appears at the output terminal 01. However, when the storing register $112_{32}$ stores data "0", the driving pulse B appears at the output terminal 032.

Figure 12:
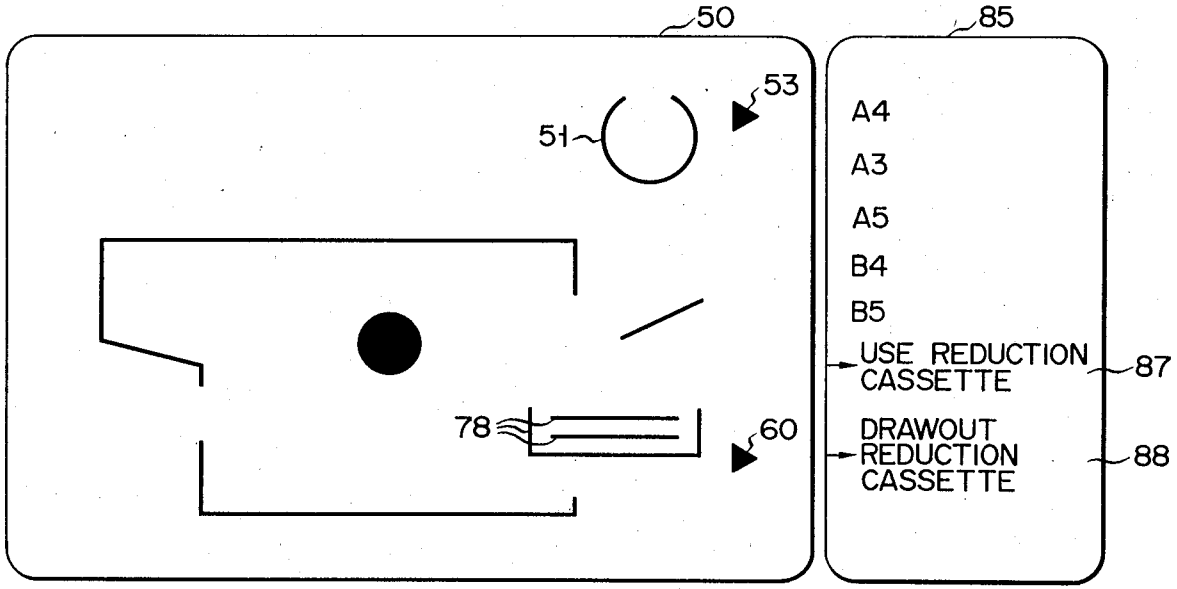
FIG. 12 shows a first example of a display when the selected operation mode does not match with the selected cassette.
Figure 13A:
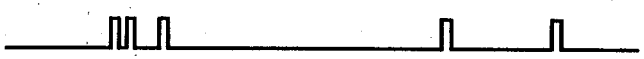
FIGS. 13A to 13C are timing charts of input signals to the liquid-crystal-display-element driving circuit in FIG. 7 for performing the display operation of FIG. 12.
Figure 13B:
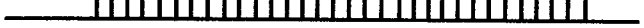
Figure 13C:
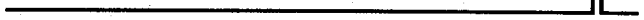

The display operation of the copying apparatus having the configuration described above will now be described with reference to FIGS. 9 to 17A to 17G. FIG. 9 shows a first display pattern, FIG. 12 shows a second display pattern, and FIG. 15 shows a third display pattern.

The first display pattern (FIG. 9) will be first explained. The A4-size copying sheets P having a feeding direction shown in FIG. 3A are set in the upper copying-sheet-feeding cassette 13. The B5-size copying sheets are set in the lower copying-sheet-feeding cassette 14. Assume that the upper copying-sheet-feeding cassette 13 is selected, and that the copying apparatus is set in the ready state. When the copying key 42 and the selection key 45 (FIG. 4) are operated, the main control section 90 receives a signal from the sheet-size and feeding-direction detecting circuit 92 which indicates that the sheet is of A4 size and that the feeding direction is the one indicated in FIG. 3A. As a result, the main control section 90 generates at its output terminal OD a data signal S1 "10100000000000000000000000010110", which indicates that the copying apparatus is set in the ready state and the upper copying-sheet-feeding cassette 13 (FIG. 3A) has been selected. When the 32-bit data of the data signal S1 is generated from the output terminal OD in response to the clock signal S5, the latching signal S4 is generated from the terminal OL. The signals S1, S4 and S5 are respectively transferred to the input terminals ID, IL and IC of the circuit 93 for driving the liquid-crystal-display elements. The signal S1 is held in the storing registers $112_1$ to $112_{32}$ in the driving circuit 93. The switches $113_1$, $113_3$, $113_{28}$, $113_{30}$ and $113_{31}$, respectively connected to the storing registers $112_1$, $112_3$, $112_{28}$, $112_{30}$ and $112_{31}$ for storing the data "1", are commonly connected to the input terminal DP1 of the driving circuit 93, so that driving pulses A are generated from the output terminals 01, 03, 023, 030 and 031. These driving pulses A are applied to segments S1, S2, S28, S30 and S31, respectively. The output terminals 02, 04 to 027, 029 and 032 of the switches respectively connected to the storing registers $112_2$, $112_4$ to $112_{27}$, $112_{29}$ and $112_{32}$ for storing data "0" respectively generate driving pulses B (FIG. 7) through the terminal DP2. These driving pulses B are applied to the segments S2, S4 to S27, S29 and S32, respectively. The common electrode 96 of the display panel 50 receives the driving pulses B, so that an AC voltage is applied between the common electrode 96 and the segments S1, S2, S28, S30 and S31, as shown in FIG. 11F. As a result, the segments S1, S3, S28 and S30 (i.e., the segments 51, 53, 78, 80 to 82, and 84 shown in FIG. 5) are turned on. Since a voltage having the same phase as that of the voltage applied to the common electrode 96 is applied to the segments S2, S4 to S27, S29 and S32, the potential difference between these segments and the common electrode 96 becomes zero, as shown in FIG. 11G. Therefore, the segments 52, 54 to 77, 79 and 83 shown in FIG. 5 will not be turned on. The resulting display content of the display section 47 (FIG. 4) is shown in FIG. 9. In particular, when the segment 51 is turned on, this indicates that the copying apparatus is set in the ready state. When the segment 78 is turned on, this indicates that the upper copying-sheet-feeding cassette 13 has been selected. When the segment 53 corresponding to the characters "A4" in the size display seal 85 is turned on, this indicates that the A4-size sheet has been selected. In this case, since the selected-copying-magnification-factor matches the sheet size and sheet feeding direction of the upper copying-sheet-feeding cassette 13, the segments 58 and 60 will not be turned on. Of course, the supplementary segments 59 and 61 are not then turned on.

The second display pattern (FIG. 12) will now be described in detail. In this case, assume that a switch 48-1 (FIG. 4) is operated to select the equal-size-copying mode, and that the operator selects the lower copying-sheet-feeding cassette 14 of FIG. 3B, although the cassette of FIG. 3A should be selected. When the operator depresses the copying key 42 (FIG. 4) after the equal-size-copying mode is set and the lower copying-sheet-feeding cassette 14 has been selected, the main control section 90 generates at its output terminal OD the data signal S2 "00100000010000000000000000010110" shown in FIG. 13A. The clock signal S5 and the latching signal S4 are produced at the timings shown in FIGS. 13B and 13C. In this case, an AC voltage having the waveform shown in FIG. 14F is applied between the segments S3, S10, S2, S30, S31, and the common electrode 96, so that only these segments are turned on. The remaining segments will not be turned on. The turning-on of the segment 53 (S3) indicates that the A4-size cassette has been selected. When the segment 60 (S10) is turned on, the guidance 88 (i.e., "DRAW OUT REDUCTION CASSETTE") on the seal 85 is indicated. This guidance 88 indicates that the lower copying-sheet-feeding cassette of FIG. 3B should be replaced by a copying-sheet-feeding cassette of FIG. 3A, since the copying apparatus is set in the equal size mode and the reduction (lower) cassette 14 of FIG. 3B has actually been selected. Therefore, the above-mentioned guidance to withdraw the reduction (lower) cassette 14 from the apparatus indicates the need to set, as the selected cassette, the cassette of FIG. 3A. In this case, when the cassette of FIG. 3A is set as the upper cassette 13, it may be selected.

Finally, the third display pattern (FIG. 15) will be described. In this case, assume that another switch such as a switch 48-3 is operated to select the reduction copying mode, and that the upper and lower cassettes 13 and 14 hold A4-size sheets having the feeding direction shown in FIG. 3A. The sheet-size and feeding-direction-detection circuit 92, shown in FIG. 7, does not generate a signal to indicate that the reduction cassette, shown in FIG. 3B, is set in the copying apparatus. In this selection state, when the operator depresses the copying key 42, the main control section 90 (FIG. 7) generates at its output terminal OD the data signal S3 (i.e., data "00100001000000000000000000010110"), which includes a signal for turning on the segment 58, as shown in FIG. 16A). FIGS. 16B and 16C are timing charts of the clock signal S5 and the latching signal S4, respectively. As a result, an AC voltage having a waveform shown in FIG. 17F is applied only between the segments S3, S8, S28, S30, S31, and the common electrode 96. These segments are turned on, and the remaining segments are kept off. When the segment 53 (S3) is turned on, this indicates that the A4-size copying sheets have been selected. When the segment 58 (S8) is turned on, the guidance 87 (i.e., "USE REDUCTION CASSETTE") is indicated. The operator sets the reduction cassette of FIG. 3B in the upper portion and selects this cassette in accordance with the guidance 87.

In the copying apparatus having the construction described above, a mismatch between the selected copying magnification factor and the size and feeding direction of the copying sheet is displayed. At the same time, the guidance to be provided to the operator in correspondence with the mismatch display is displayed, thereby simplifying the operation. In addition to this advantage, wastage of the copying sheets does not occur. The display color of the copying sheet size differs from that of the mismatch display, which further simplifies operator recognition. The copying operation in the mismatch state, wherein the copying magnification factor does not match the size and feeding direction of the copying sheet, can be deliberately performed. The sheet size and mismatch displays do not interrupt the copying operation, so the copying operation in the mismatched state is not interrupted. A film printed with symbols or characters to be displayed may be illuminated from its lower surface, instead of using the liquid-crystal-display means. In a further modification, the display segments may flash. In addition, the present invention may be applied to any image forming apparatus for selectively feeding image forming sheets of different sizes and feeding directions.

What is claimed is:

1. An image forming apparatus comprising:

means for selecting one cassette which is detachably loaded in said image forming apparatus, each of said cassettes holding a plurality of copying sheets having a specified size and a specified feeding direction of said sheets;

means for detecting said specified size and said specified feeding direction of said sheets contained in said selected cassette;

means for selecting an operation mode in response to which a required image forming magnification factor is selected; and display means for displaying operation conditions of said image forming apparatus, said display means including:

a display panel section including a plurality of first light-emitting indicating units for indicating the type of cassette selected, and a plurality of second light-emitting indicating units for indicating when said selected operation mode is mismatched with said selected cassette; and an indicating section including a plurality of symbols arranged to correspond to said first light-emitting indicating units, each of said symbols indicating the size of the copying sheets contained in said selected cassette, and a plurality of instructions in the form of characters arrranged to correspond to said second light-emitting indicating units, said instructions instructing an operator to replace said selected cassette when one of said second light-emitting indicating units is activated.

2. An image forming apparatus according to claim 1, wherein said second light-emitting indicating units emit a first color light and said first light-emitting indicating units emit a second color light.

* * * * *